US006003335A

United States Patent [19]

Gurevich et al.

[11] Patent Number: 6,003,335

[45] Date of Patent: Dec. 21, 1999

[54] MULTI-STONE CENTER SETTING FOR DIAMONDS AND GEMSTONES

[75] Inventors: Zelik Gurevich; Michael Schachter, both of New York, N.Y.

[73] Assignee: Orion Diamond Inc., New York, N.Y.

[21] Appl. No.: 09/320,294

[22] Filed: May 26, 1999

[51] Int. Cl.[6] ..... A44C 17/02

[52] U.S. Cl. ..... 63/26; 63/27; 63/28; D11/91; D11/92

[58] Field of Search ..... 63/26, 27, 28, 63/29.1; D11/89, 90, 91, 92

[56] References Cited

U.S. PATENT DOCUMENTS

| | | | |
|---|---|---|---|
| D. 80,898 | 4/1930 | Kaufman | D11/92 |
| D. 386,443 | 11/1997 | Itzkowitz . | |
| D. 387,302 | 12/1997 | Itzkowitz . | |
| D. 388,015 | 12/1997 | Itzkowitz . | |
| D. 388,016 | 12/1997 | Kejejian . | |
| D. 388,017 | 12/1997 | Kejejian . | |
| D. 400,121 | 10/1998 | Ambar . | |
| D. 403,611 | 1/1999 | Lai . | |
| D. 411,134 | 6/1999 | Lai | D11/92 |
| 2,207,869 | 7/1940 | Monnier | 63/32 |
| 2,733,579 | 2/1956 | Pfeffer et al. | 63/29.1 |
| 2,907,187 | 10/1959 | Karp et al. | 63/28 |
| 5,123,265 | 6/1992 | Ramot . | |
| 5,520,017 | 5/1996 | Vivat . | |
| 5,848,539 | 12/1998 | Ouzounian . | |

FOREIGN PATENT DOCUMENTS

| | | | |
|---|---|---|---|
| 585940 | 3/1925 | France | 63/28 |
| 802367 | 9/1936 | France | 63/28 |

*Primary Examiner*—Terry Lee Melius
*Assistant Examiner*—Andrea Chop
*Attorney, Agent, or Firm*—Ezra Sutton

[57] ABSTRACT

A multi-stone setting for four gemstones, including a rectangular-shaped setting having a four-sided frame member with a first crossbar extending in a first direction and a second crossbar extending in a second direction perpendicular to the first direction. The first and second crossbars form four seats each for receiving one of the four gemstones, wherein the four gemstones each include a side wall having a groove. The first crossbar is seated within the four grooves for keeping the four gemstones seated in the four seats. The setting also has four corners with four prongs mounted on the four corners, respectively; wherein each of the four prongs has a V-shaped configuration for engaging two side walls of one of the four gemstones. Each of the four V-shaped corner prongs cooperate to engage and to keep one of the four gemstones seated within the four seats of the setting.

27 Claims, 11 Drawing Sheets

MULTI-STONE CENTER SETTING FOR DIAMONDS AND GEMSTONES

FIELD OF THE INVENTION

The present relates to a multi-stone center setting for holding therein four or six rectangular-shaped or square-shaped gemstones (princess cut gemstones) in which the combined gemstone aggregate gives a larger appearance than that of a single gemstone of a similar carat weight. More particularly, this multi-stone center setting having four to six gemstones therein gives the appearance that the setting is substantially invisible.

BACKGROUND OF THE INVENTION

Invisible gemstone settings are well known in the art and refers to a setting for gemstones in which the setting lies beneath the visible surface of the gemstones. Typically, to invisibly set a large number of gemstones, the approach of the prior art has been to notch the gemstones and to mount them in a setting having two or more parallel walls, with metallic projections, for example, prongs or the like, protruding from these walls for engaging the notches. Generally, these walls define channels in which the gemstones are set abutting one another in accordance with the invisible mounting method.

Invisible gemstone settings for jewelry products suffer from a number of disadvantages. First, casting of a jewelry item with a gemstone region including a recess and walls and preparing T-shaped cross bars is a relatively difficult and therefore costly process. Second, the assembly of the jewelry item requires considerable time of a skilled worker which adds greatly to the overall cost of the jewelry item. And third, the finished jewelry item cannot be readily downsized without disturbing the invisible gemstone setting.

Therefore, there remains a need for a novel invisible and multiple gemstone setting for jewelry ornaments which overcomes the disadvantages of conventional multi-stone and invisible gemstone settings for jewelry items. The multi-stone center setting would include a rectangular-shaped or square-shaped metal setting for holding four to six princess cut gemstones in which the combined gemstone aggregate gives a larger appearance than that of a single gemstone of a similar carat weight. Additionally, the multi-stone center setting would give the appearance that the setting (metal) is essentially invisible to the eye of the wearer.

DESCRIPTION OF THE PRIOR ART

Invisible gemstone settings, multi-gemstone settings, jewelry settings and the like having various designs, structures, configurations and functions have been disclosed in the prior art. For example, U.S. Pat. No. 5,848,539 to OUZOUNIAN discloses an invisible, multiple precious stone setting for mounting two or more rows of round-shaped precious stones. This prior art patent does not disclose the structure and configuration of the present invention.

U.S. Pat. No. 5,520,017 to VIVAT discloses jewelry items with invisible gemstone settings, wherein the gemstone setting includes a least two walls so as to provide at least one groove. The groove slidably receives one or more rectangularly-shaped precious stones therein. This prior art patent does not disclose the structure and configuration of the present invention.

U.S. Pat. No. 5,123,265 to RAMOT discloses an invisible gemstone setting, wherein the gemstone setting assembly includes one or more gemstones and a setting having a base formed with a plurality of ribs defining one or more sockets of polygonal configuration for receiving the gemstones. This prior art patent does not disclose the structure and configuration of the present invention.

Design U.S. Pat. No. D403,611 to LAI discloses an ornamental design for a jewelry setting having a square-shaped grid pattern for square-shaped gemstones. This prior art patent does not disclose the structure and configuration of the present invention.

None of the aforementioned prior art patents disclose or teach the multi-stone center setting of the present invention for receiving therein four or six rectangular-shaped or square-shaped gemstones which gives the appearance of a single gemstone by essentially giving the setting an invisible profile.

Accordingly, it is an object of the present invention to provide a multi-stone setting for holding therein four or six rectangular-shaped or square-shaped gemstones in which the combined aggregate of the four or six gemstones give a larger appearance than that of a single gemstone of a similar carat weight (i.e., a 1.2 carat presentation of the combined four or six gemstones appears as large as a 2.0 carat gemstone, as the present invention would have a larger table).

Another object of the present invention is to provide a multi-stone setting having four or six gemstones therein that is less expensive than a single gemstone of a similar carat weight (i.e., the 1.2 carat presentation of the combined four or six gemstones is less expensive than an actual 1.2 carat single gemstone of the same carat weight).

Another object of the present invention is to provide a multi-stone setting having four or six princess cut gemstones therein which gives the appearance that the setting is substantially invisible at distances greater than 12 inches from the jewelry product.

Another object of the present invention is to provide a multi-stone setting that can be varied in size depending upon the total combined carat weight of the four or six gemstones within the setting.

Another object of the present invention is to provide a multi-stone setting that can be made from precious metals such as gold, silver, platinum or palladium for setting precious gemstones including diamonds, rubies, sapphires, emeralds and the like.

Another object of the present invention is to provide a multi-stone setting having four or six gemstones therein for use in personal adornment in the form of ornamental jewelry such as rings, pins, brooches, pendants, clasps, necklaces, bracelets, anklets and earrings.

Another object of the present invention is to provide a multi-stone setting that can be produced in an economical manner and is readily affordable by the jewelry consumer.

SUMMARY OF THE INVENTION

In accordance with the present invention, there is provided a multi-stone setting for four gemstones or diamonds each having four side walls. The multi-stone setting includes a rectangular-shaped setting having a four-sided frame member with a first crossbar extending in a first direction and a second crossbar extending in a second direction perpendicular to the first direction. The first and second crossbars form four seats each for receiving one of the four gemstones, wherein the four gemstones each include a side wall having a groove. The first crossbar is seated within the four grooves for keeping the four gemstones seated in the four seats. The setting also has four corners with four prongs mounted on the four corners, respectively; wherein each of the four prongs has a V-shaped configuration for engaging two side walls of one of the four gemstones. Each of the four V-shaped corner prongs cooperate to engage and to keep one of the four gemstones seated within the four seats of the setting.

BRIEF DESCRIPTION OF THE DRAWINGS

Further objects, features, and advantages of the present invention will become apparent upon the consideration of the following detailed description of the presently-preferred embodiment when taken in conjunction with the accompanying drawings, wherein.

DETAILED DESCRIPTION OF THE PREFERRED EMBODIMENT 10

Figure 1:
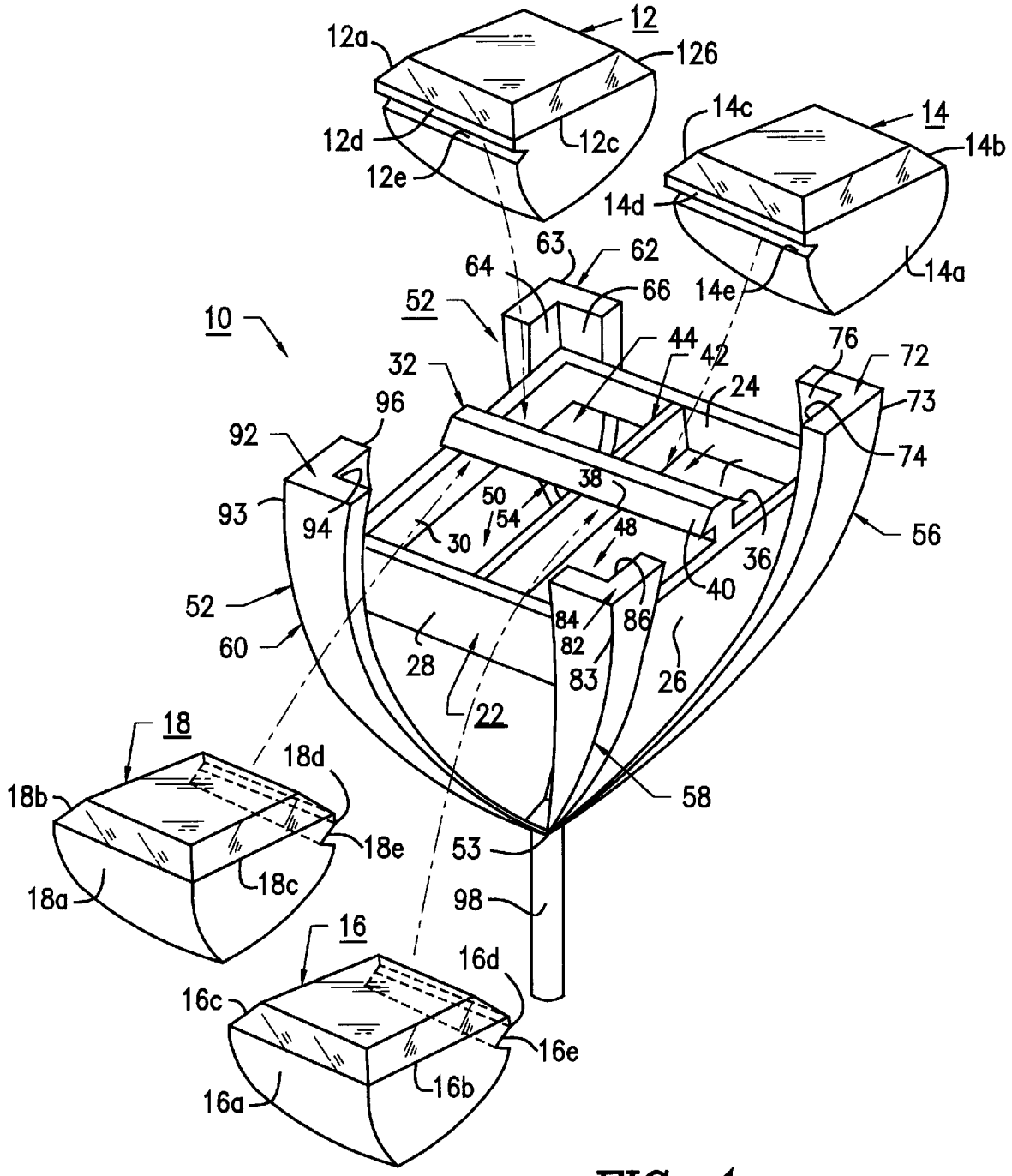
FIG. 1 is a top perspective view of the multi-stone center setting for holding four gemstones or diamonds of the preferred embodiment of the present invention.

The multi-stone setting 10 and its component parts of the preferred embodiment of the present invention are represented in detail by FIGS. 1 through 10 of the patent drawings. The multi-stone setting 10 is used for holding in place four (4) rectangular-shaped or square-shaped diamonds 12, 14, 16 and 18 with each diamond 12 to 18 having four side walls 12*a* to 12*d*, 14*a* to 14*d*, 16*a* to 16*d* and 18*a* to 18*d*, respectively. The multi-stone setting 10, as shown in FIG. 1 of the drawings, includes a rectangular-shaped or square-shaped gemstone setting 10 having an upper frame member 22, a curved corner section assembly 52 and a setting connecting bar member 98.

Figure 2:
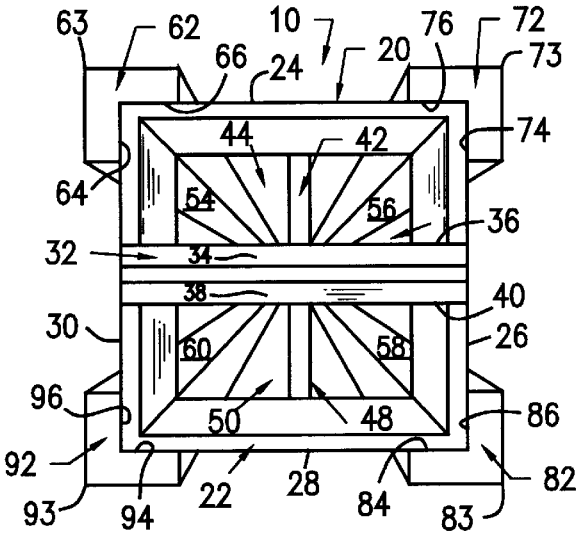
FIG. 2 is a top plan view of the multi-stone setting of the present invention shown in FIG. 1.
Figure 3:
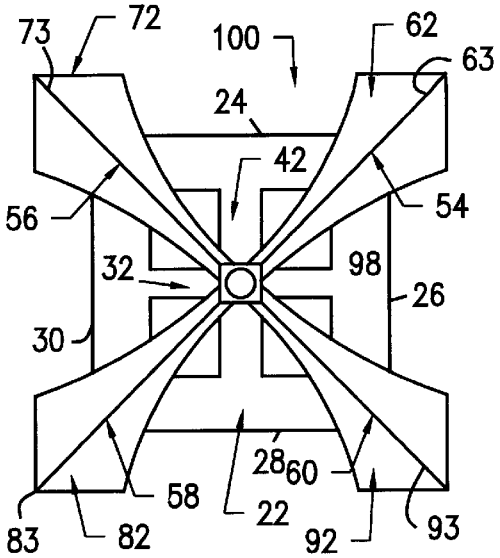
FIG. 3 is a bottom plan view of the multi-stone setting of the present invention shown in FIG. 1.
Figure 4:
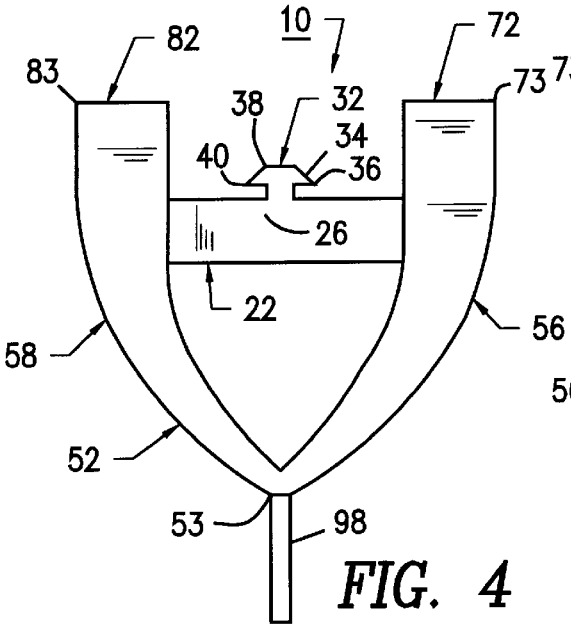
FIG. 4 is a side elevational view of the multi-stone setting of the present invention shown in FIG. 1.
Figure 5:
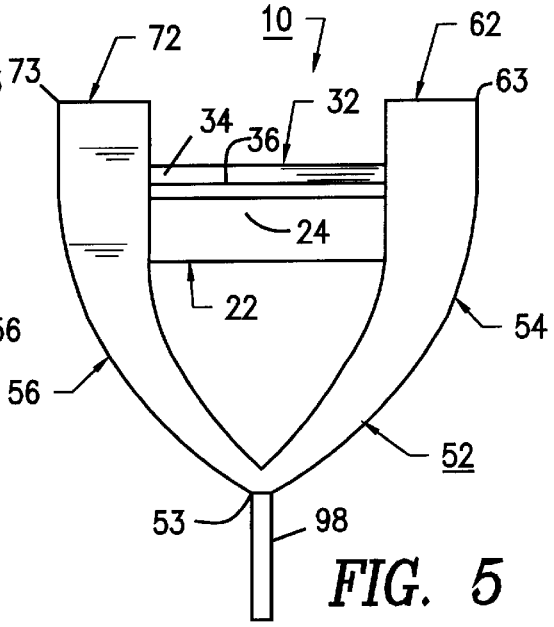
FIG. 5 is a front elevational view of the multi-stone setting of the present invention shown in FIG. 1.
Figure 6:
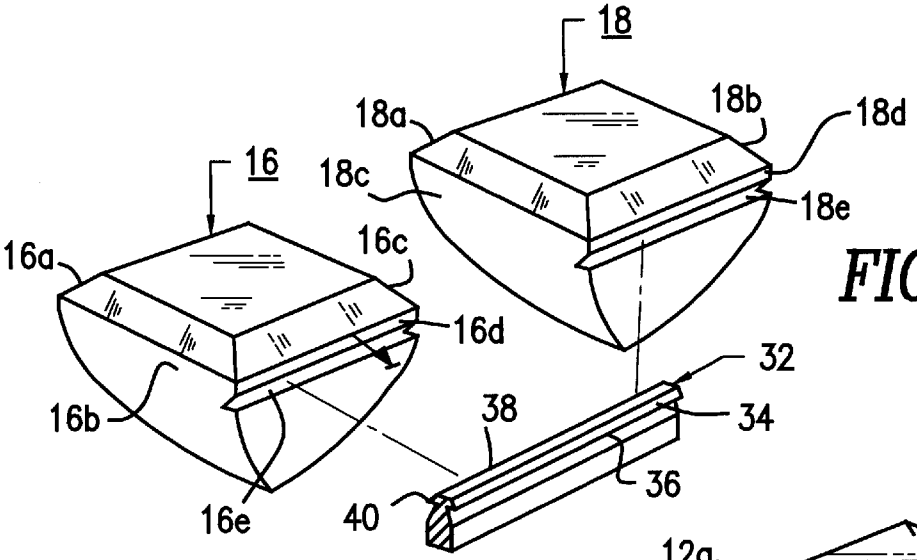
FIG. 6 is a top perspective view of the multi-stone setting of the present invention showing two square-shaped diamonds being slidably connected with the upper crossbar of the frame member.
Figure 7:
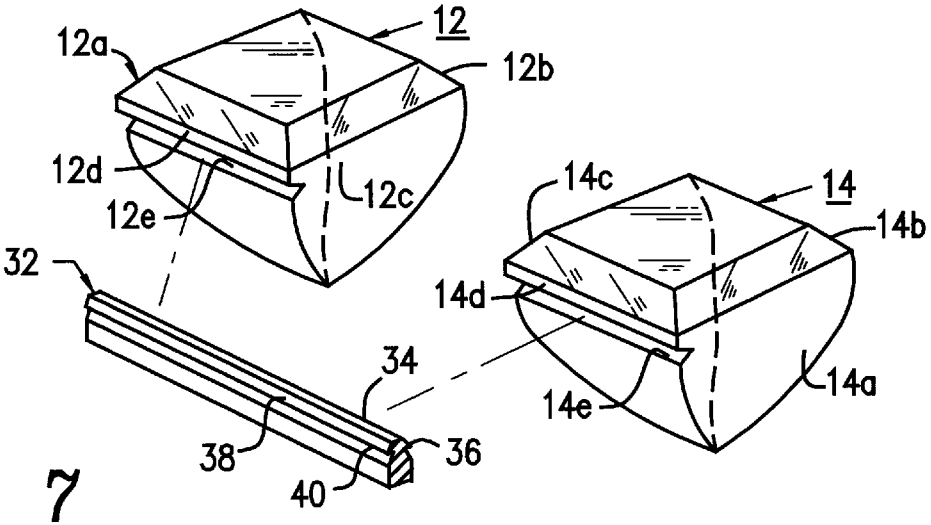
FIG. 7 is a top perspective view of the multi-stone setting of the present invention showing two square-shaped diamonds being slidably connected with the upper crossbar of the frame member.

The upper frame member 22 includes four side frame members 24, 26, 28 and 30; a first crossbar 42 connected to the two opposing side frame members 24 and 28; and a second or upper crossbar 32 mounted on top of first or lower crossbar 42 with the second crossbar 32 connected to the other two opposing side frame members 26 and 30 for forming four seats 44, 46, 48 and 50 with the four seats 44 to 50 each having a rectangular or square shape, as shown in FIGS. 1 and 2 of the drawings. The four seats 44 to 50 are used to retain and hold in place diamonds 12 to 18, respectively. Additionally, the first crossbar 42 extends in a first direction and the second crossbar 32 extends in a second direction perpendicular to the first direction, as shown in FIG. 2 of the drawings. Also, the second crossbar 32 includes a first wall surface 34 having a first retaining insert edge member or projection member 36 thereon, and also includes a second wall surface 38 having a second retaining insert edge member or projection member 40 thereon. First and second retaining insert edge members or projection members 36 and 40 of crossbar 32 are used to slidably connect within cut-grooves/grooved slots 12*e*, 14*e*, 16*e* and 18*e* formed within diamonds 12, 14, 16 and 18, respectively, as depicted in FIGS. 6 and 7 of the drawings.

Figure 8:
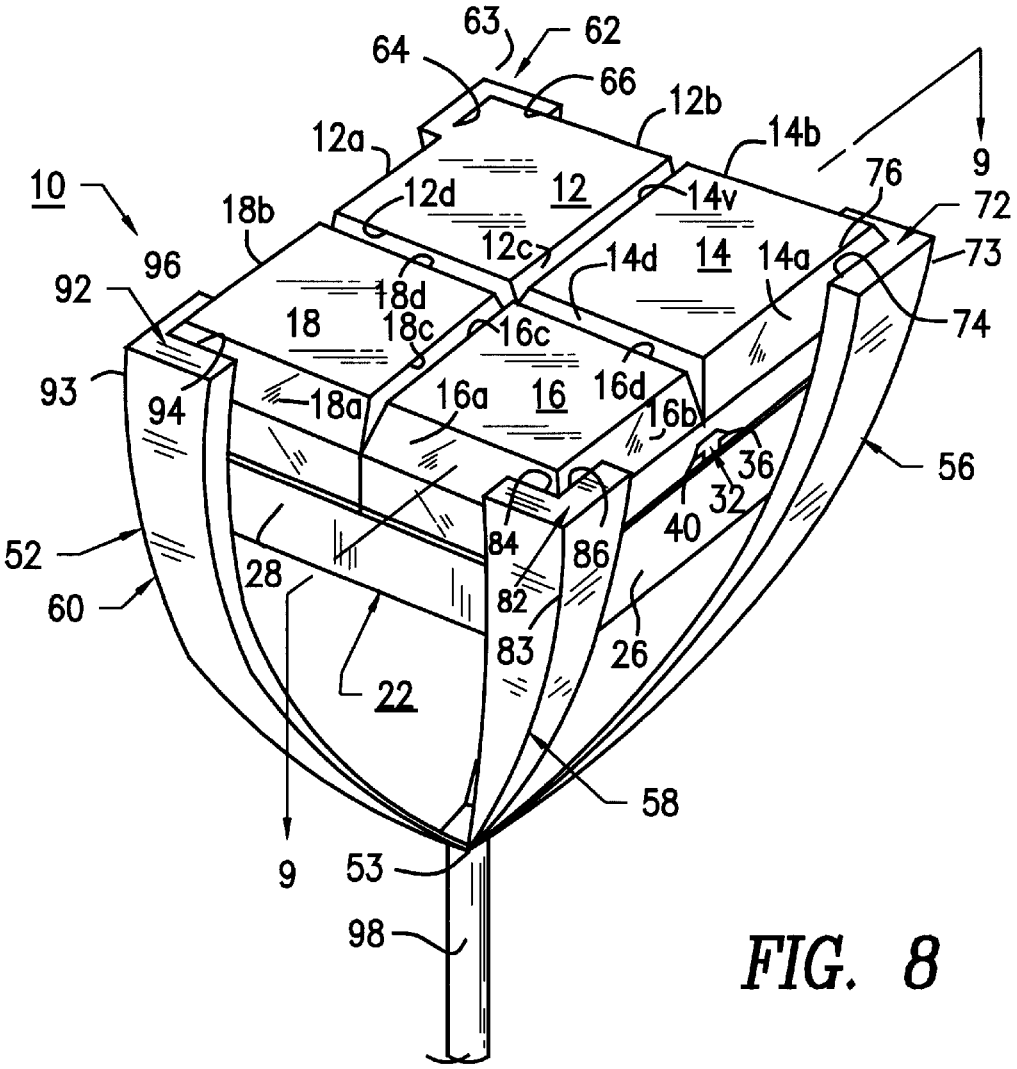
FIG. 8 is a top perspective view of the multi-stone setting of the present invention showing four square-shaped diamonds seated within the four seats of the gemstone setting.
Figure 9:
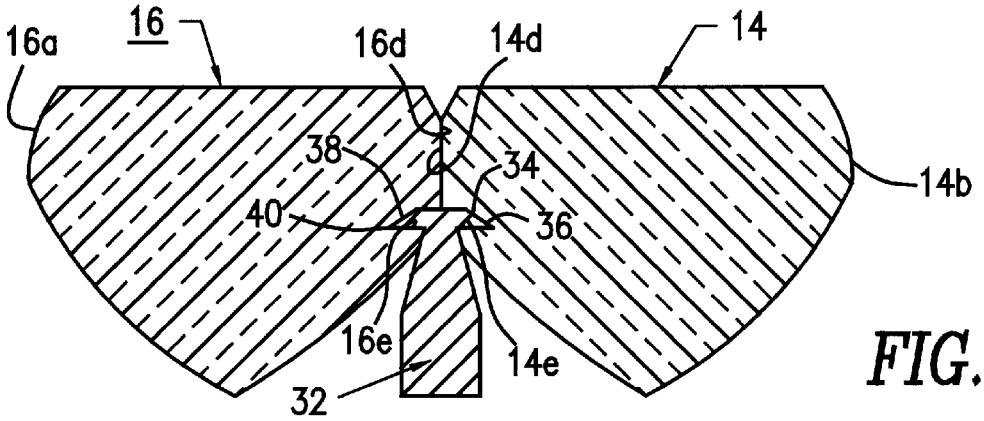
FIG. 9 is a cross-sectional view of the multi-stone setting of the present invention taken along lines 9—9 of FIG. 8 showing the upper crossbar within the cut grooves of two diamonds.
Figure 10A:
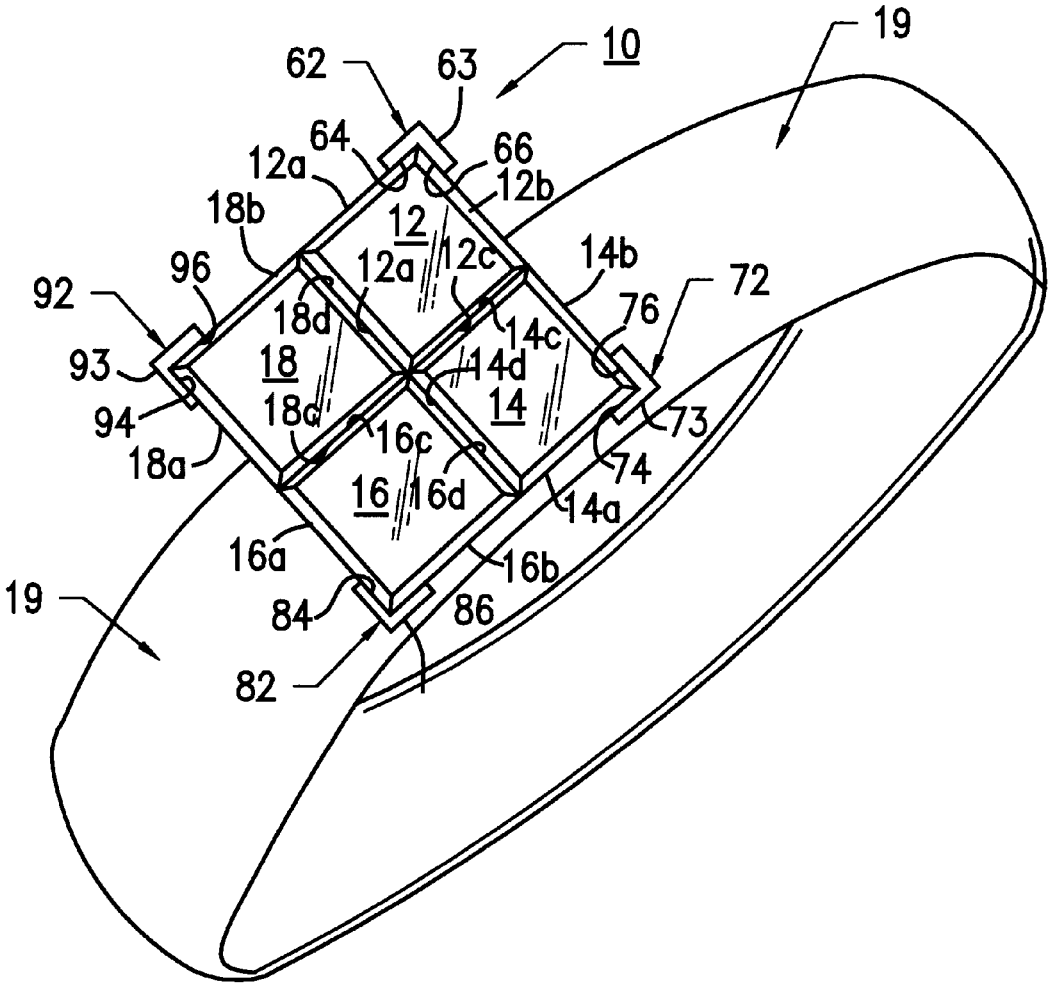
FIG. 10A is a top perspective view of the multi-stone setting of the present invention showing four square-shaped diamonds seated within the four seats of the gemstone setting and being connected to a ring holding member to form a diamond ring.

The curved corner section assembly 52 includes, as shown in FIGS. 1, 8 and 10A, section members 54, 56, 58 and 60 having upper V-shaped prong holding members 62, 72, 82 and 92, respectively, thereon. Each V-shaped configuration of prong holding members 66, 72, 82 and 92 is formed into a right-angle (90°) configuration, as shown in FIG. 1. Each prong holding member 62, 72, 82 and 92 includes first and second retaining wall members 64, 66; 74, 76; 84, 86; 94 and 96; respectively, for engaging and holding two side walls of each diamond 12, 14, 16 and 18, respectively. First and second retaining wall members 64 and 66 of prong 62 engage side walls 12*a* and 12*b* of diamond 12, respectively. First and second retaining wall members 74 and 76 of prong 72 engage side walls 14*a* and 14*b* of diamond 14, respectively. First and second retaining wall members 84 and 86 of prong 82 engage side walls 16*a* and

Figure 10B:
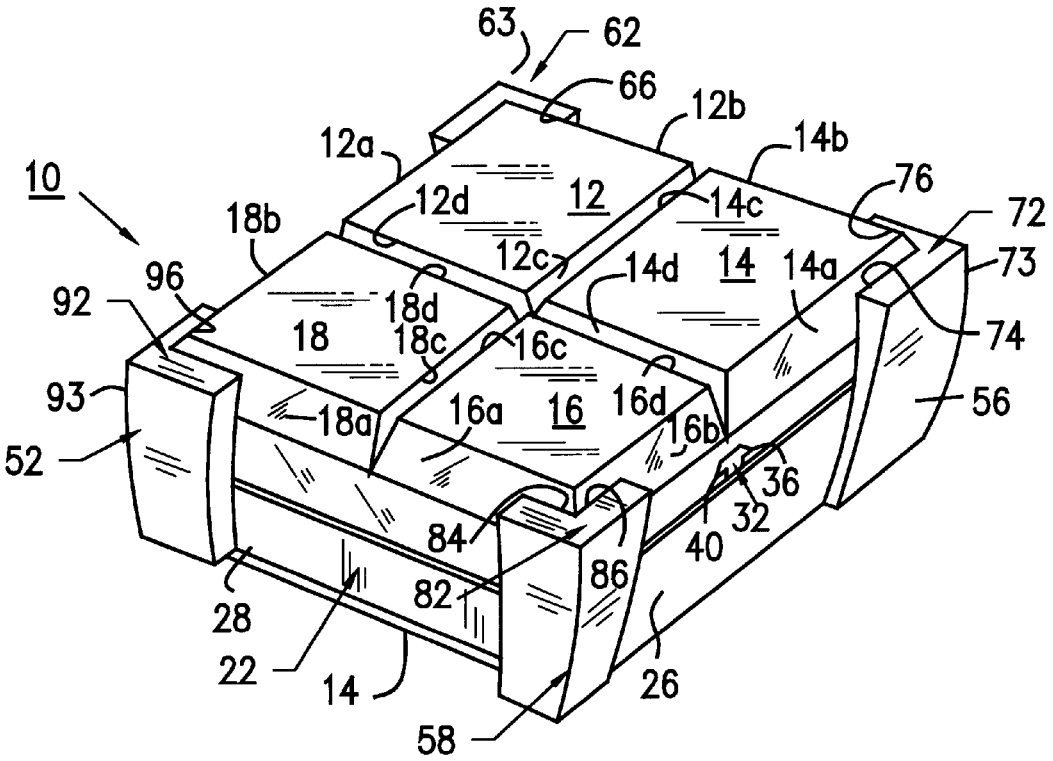
FIG. 10B is a top perspective view of the multi-stone setting of the present invention showing four rectangular-shaped diamonds seated within the four seats of the setting for forming a pin.

16*b* of diamond 16, respectively. First and second retaining wall members 94 and 96 of prong 92 engage side walls 18*a* and 18*b* of diamond 18, respectively. The four corner prong holding members 62, 72, 82 and 92 further include upper ends 63, 73, 83 and 93, respectively, wherein the upper ends 63, 73, 83 and 93 are higher than the four side frame members 24, 26, 28 and 30 of the frame member 22 for directly engaging the respective side walls of the four diamonds 12, 14, 16 and 18, respectively, as depicted in FIGS. 1, 10A and 10B of the drawings.

Each of the curved corner section members 54, 56, 58 and 60 of corner section assembly 52 are integrally connected and joined together at the bottom end point 53, as shown in FIGS. 1, 3, 4 and 5 of the drawings. The setting connecting bar member 98 is also integrally attached at the bottom end point 53. Connecting bar member 98 is used for attachment to a ring member 19 or other jewelry products such as pins, brooches, pendants, clasps, necklaces, bracelets, anklets and earrings, as shown in FIGS. 10A and 10B of the drawings.

The gemstone setting 10 can be made of gold, silver, platinum, palladium, or other precious metals. Gemstone setting 10 can also be made into different size settings depending upon the size (carat weight) of the rectangular-shaped or square-shaped diamonds 12 to 18 being mounted therein. The total carat weight for the four gemstones or diamonds 12 to 18 typically is in the range of 0.16 to 2.0 carats per gemstone setting 10. Additionally, other types of gemstones such as rubies, emeralds and sapphires can be used for the multi-stone setting 10 of the present invention.

DETAILED DESCRIPTION OF THE ALTERNATE EMBODIMENT 100

Figure 11:
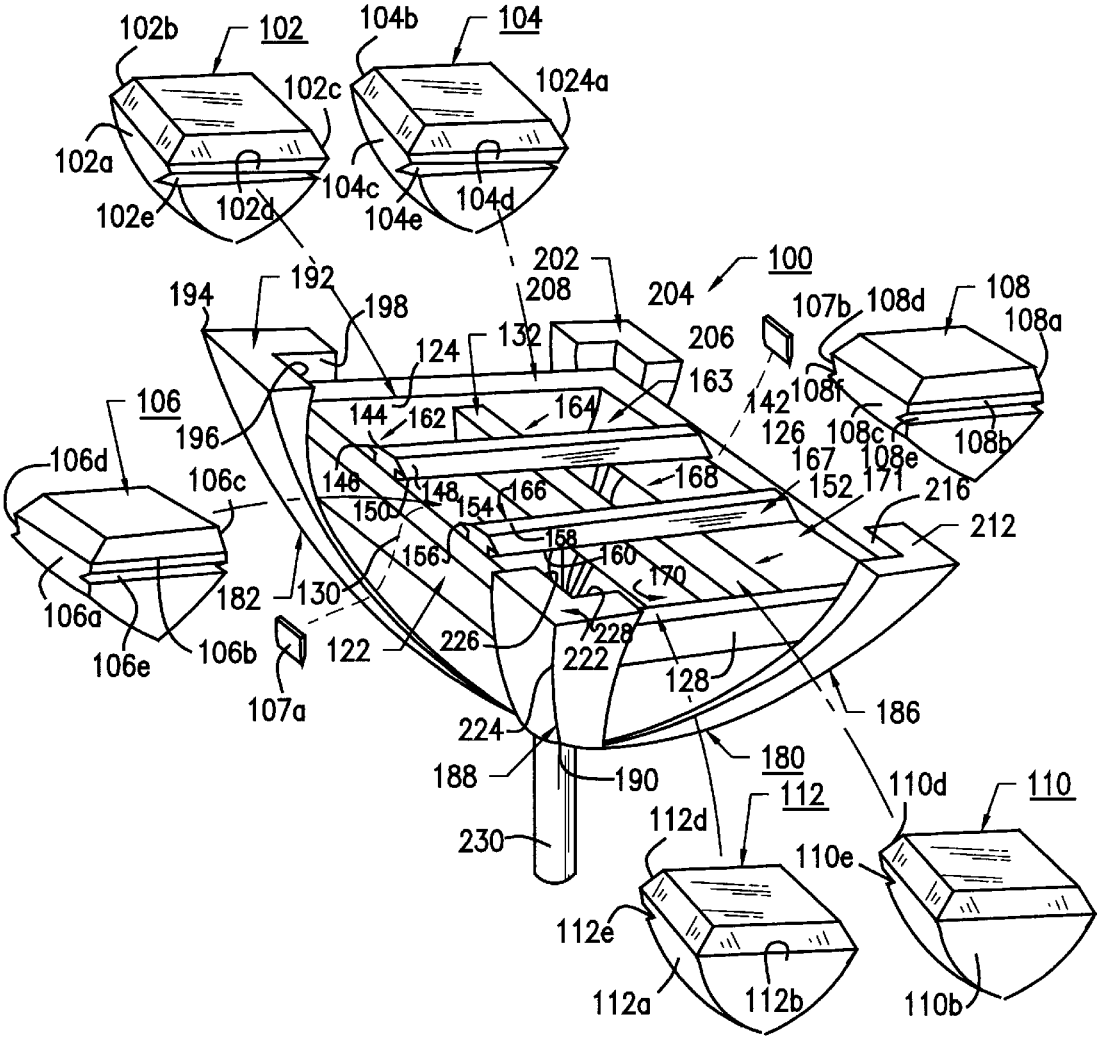
FIG. 11 is a top perspective view of an alternative embodiment of the multi-stone setting for holding six gemstones or diamonds of the present invention.
Figure 13:
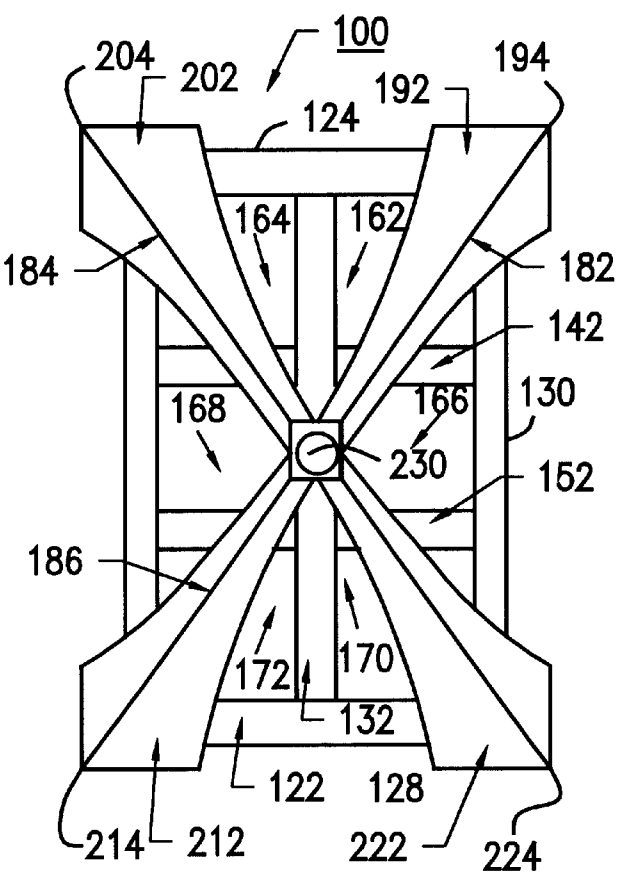
FIG. 13 is a bottom plan view of the multi-stone setting of the present invention shown in FIG. 11.

The multi-stone setting 100 and its component parts of the alternate embodiment of the present invention are represented in detail by FIGS. 11 through 18 of the patent drawings. The multi-stone setting 100 is used for holding in place six (6) rectangular-shaped or square-shaped diamonds 102, 104, 106, 108, 110 and 112 with each diamond 102 to 112 having four side walls 102*a* to 102*d*, 104*a* to 104*d*, 106*a* to 106*d*, 108*a* to 108*d*, 110*a* to 110*d*, and 112*a* to 112*d*, respectively. The multi-stone setting 100, as shown in FIG. 11 of the drawings, includes a rectangular-shaped gemstone setting 100 having an upper frame member 122, a curved corner section assembly 180 and a setting connecting bar member 230.

Figure 12:
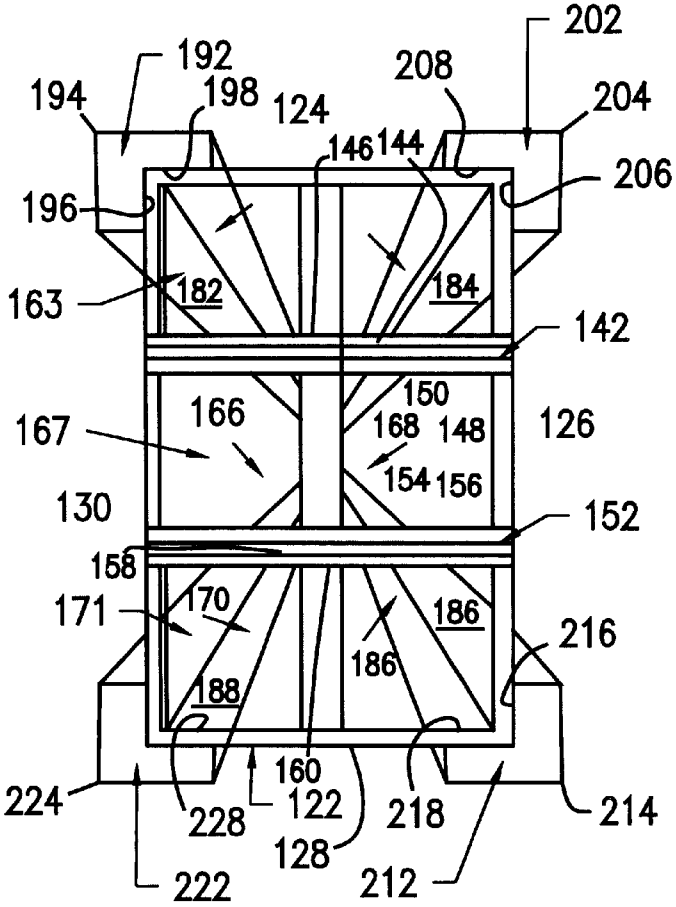
FIG. 12 is a top plan view of the multi-stone setting of the present invention shown in FIG. 11 with the frame member having first, second and third crossbars therein that form six seats for receiving six rectangular-shaped or square-shaped diamonds therein.
Figure 15:
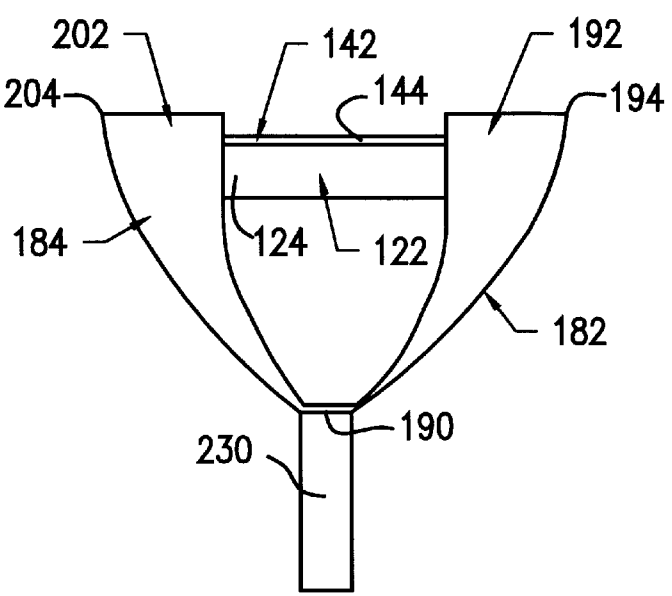
FIG. 15 is a front elevational view of the multi-stone setting of the present invention shown in FIG. 11 showing the second crossbar.
Figure 14:
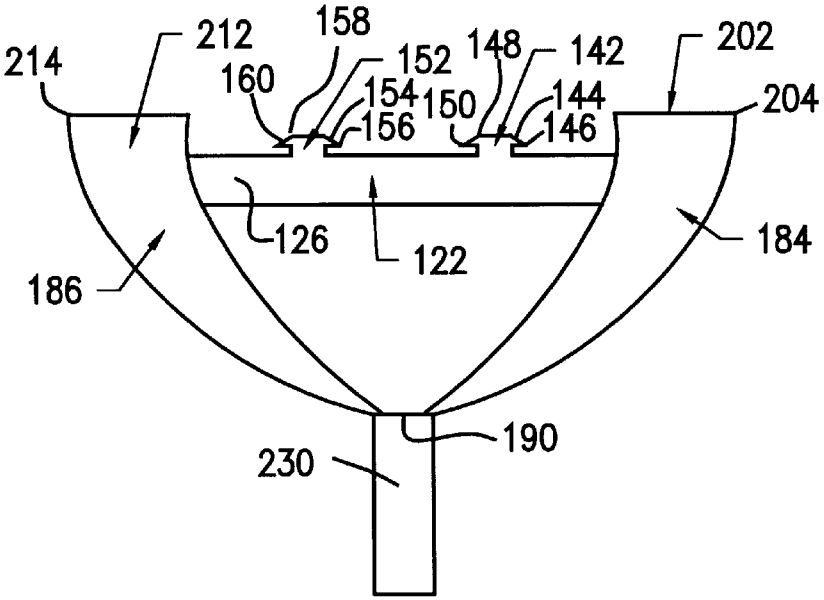
FIG. 14 is a side elevational view of the multi-stone setting of the present invention shown in FIG. 11 showing the second and third crossbars.

The upper frame member 122 includes four side frame members 124, 126, 128 and 130; a first crossbar 132 connected to the two opposing side frame members 124 and 128; and second and third or upper crossbars 142 and 152 being equally spaced-apart and parallel with each other are mounted on top of the first or lower crossbar 132. The second and third crossbars 142 and 152 are connected to the other two opposing side frame members 126 and 130. The first, second and third crossbars 132, 142 and 152 are used for forming six seats 162, 164, 166, 168, 170 and 172 having a rectangular or square shape, as shown in FIGS. 11 and 12 of the drawings. Each of the six seats 162 to 172 are used to retain and hold in place diamonds 102 to 112, respectively, such that the first, second and third crossbars 132, 142 and 152 define two outer rows 163 and 171 of seats (first outer row 163 includes seats 162 and 164 and the second outer row 171 includes seats 170 and 172), and one inner row 167 of seats (inner row 167 includes seats 166 and 168) for receiving the six diamonds 102 to 112 therein. Additionally, the first crossbar 132 extends in a first direction, the second crossbar 142 extends in a second direction perpendicular to the first direction, and the third crossbar 152 being parallel to the second crossbar 142 also extends in the second direction, as shown in FIG. 12 of the drawings. The second crossbar 142 includes a first wall surface 144 having a first retaining insert edge member or projection member 146 thereon, and also includes a second wall surface 148 having a second retaining insert edge member or projection member 150 thereon. The third crossbar 152 includes a first wall surface 154 having a first retaining insert edge member or projection member 156 thereon, and also includes a second wall surface 158 having a second retaining insert edge member or projection member 160 thereon.

The first outer row 163 includes diamonds 102 and 104 having grooved slots 102*e* and 104*e* formed on their respective side walls 102*d* and 104*d*, respectively, wherein grooved slots 102*e* and 104*e* of diamonds 102 and 104 engage the first retaining insert edge member 146 of the second crossbar 142 for nesting and seating the first outer row 163 of diamonds 102 and 104 on the second crossbar 142, as shown in FIG. 11 of the drawings. The second outer row 171 includes diamonds 110 and 112 having grooved slots 110*e* and 112*e* formed on their respective side walls 110*d* and 112*d*, respectively, wherein grooved slots 110*e* and 112*e* of diamonds 110 and 112 engage the first retaining insert edge member 156 of the third crossbar 152 for nesting and seating the second outer row 171 of diamonds 110 and 112 on the third crossbar 152, as shown in FIG. 11 of the drawings. The inner row 167 includes diamonds 106 and 108 having grooved slots 106*e* and 106*f*, and 108*e* and 108*f* formed on their opposite side walls 106*b* and 106*d*, and 108*b* and 108*d*, respectively, wherein grooved slots 106*f* and 108*f* of diamonds 106 and 108 engage the second retaining insert edge member 150 of the second crossbar 142 for nesting and seating of side walls 106*d* and 108*d* of diamonds 106 and 108 on the second crossbar 142. Also, grooved slots 106*e* 173 and 108*e* of diamonds 106 and 108 engage the second retaining insert edge member 160 of the third crossbar 152 for nesting and seating of side walls 106*b* and 108*b* of diamonds 106 and 108 on the third crossbar 152, as depicted in FIG. 11 of the drawings.

Figure 16:
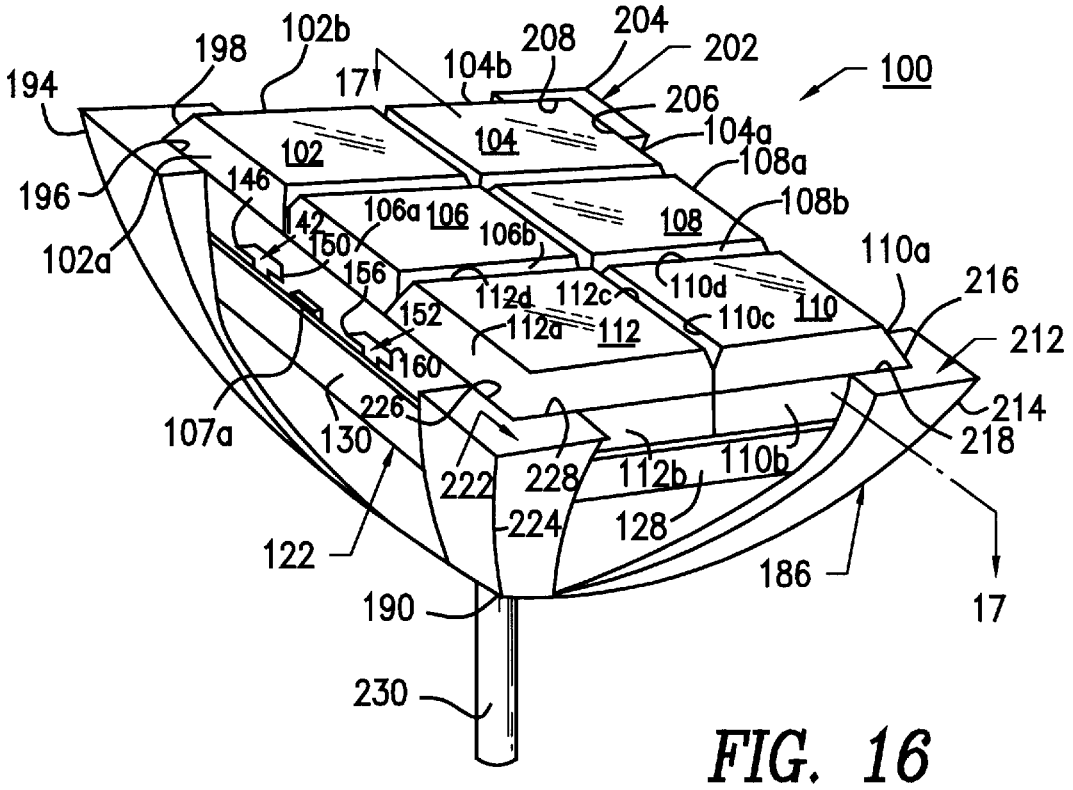
FIG. 16 is a top perspective view of the multi-stone setting of the present invention shown in FIG. 11 showing six square-shaped diamonds seated within the six seats of the setting.
Figure 18:
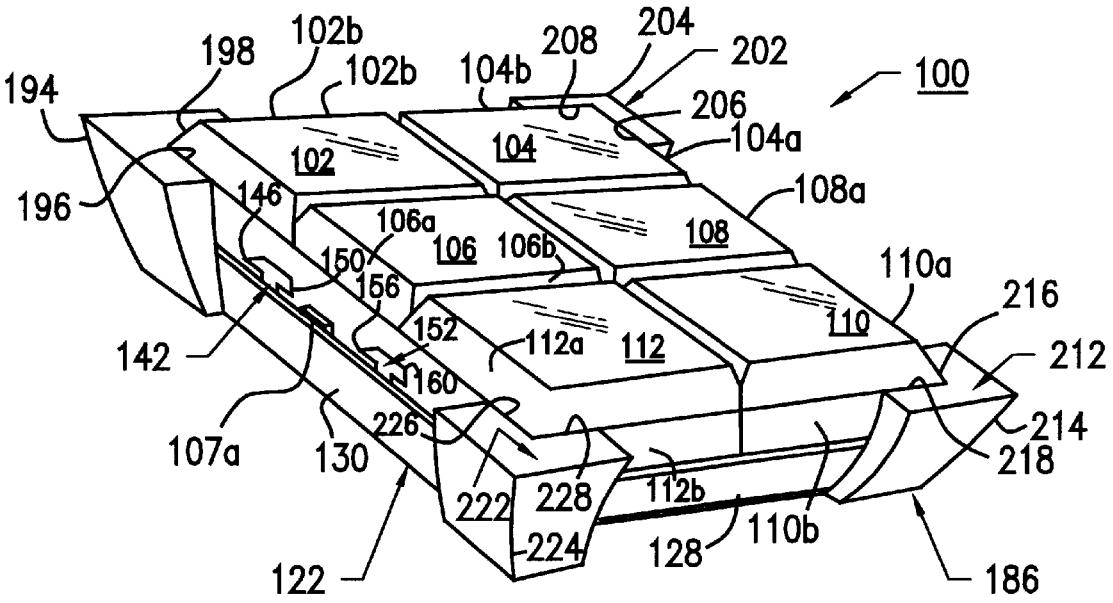
FIG. 18 is a top perspective view of the multi-stone setting of the present invention showing six rectangular-shaped diamonds seated within the six seats of the setting for forming a clasp.

The curved corner section assembly 180, as shown in FIGS. 11, 16 and 18 of the drawings, includes four corner section members 182, 184, 186 and 188 having upper V-shaped prong holding members 192, 202, 212 and 222, respectively, thereon. Each V-shaped configuration of prong holding members 192, 202, 212 and 222 is formed into a right angle (90°) configuration, as shown in FIG. 11. Each prong holding member 192, 202, 212 and 222 includes first and second retaining wall members 196, 198; 206, 208; 216, 218; 226 and 228; respectively, for engaging and holding two side walls of the outer rows 163 and 171 of diamonds 102, 104, 110 and 112, respectively. First and second retaining wall members 196 and 198 of prong 192 engage side walls 102*a* and 102*b* of diamond 102, respectively. First and second retaining wall members 206 and 208 of prong 202 engage side walls 104*a* and 104*b* of diamond 104, respectively. First and second retaining wall members 216 and 218 of prong 212 engage side walls 110*a* and 110*b* of diamond 110, respectively. First and second retaining wall members 226 and 228 of prong 222 engage side walls 112*a* and 112*b* of diamond 112, respectively. The four corner prong holding members 192, 202, 212 and 222 further include upper ends 194, 204, 214 and 224, respectively, wherein the upper ends 194, 204, 214 and 224 are higher than the four side frame members 124 to 130 of frame member 122 for directly engaging the respective side walls of the outer row diamonds 102, 140, 110 and 112, respectively, as depicted in FIGS. 11, 16 and 18 of the drawings.

Each of the curved corner section members 182 to 188 of corner section assembly 180 are integrally connected and joined together at the bottom end point 190, as shown in FIGS. 11, 13, 14 and 15 of the drawings. The setting connecting bar member 230 is also integrally attached at the bottom end point 190. Connecting bar member 230 is used for attachment to a clasp member 114 or other jewelry products such as rings, pins, brooches, pendants, necklaces, bracelets, anklets and earrings, as shown in FIG. 18 of the drawings.

The gemstone setting 100 can be made of gold, silver, platinum, palladium, or other precious metals. Gemstone setting 100 can also be made into different size settings depending upon the size (carat weight) of the rectangular-shaped or square-shaped diamonds 102 to 112 being mounted therein. The total carat weight for the six gemstones or diamonds 102 to 112 typically is in the range of 0.18 to 2.00 carats per gemstone setting 100. Additionally, other types of gemstones such as rubies, emeralds and sapphires can be used for the multi-stone setting 100 of the present invention. The present invention is directed to a multi-stone setting for diamonds or gemstones and it is understood that one skilled in the art would be capable of adapting the present invention for use with a greater number of gemstones.

OPERATION OF THE PRESENT INVENTION PREFERRED EMBODIMENT 10

The operation of the multi-stone setting 10 of the preferred embodiment of the present invention, as shown in FIGS. 1 and 6 through 10A and 10B of the patent drawings, starts with the jeweler initially mounting the connecting bar member 98 to a jewelry vise (not shown) for the convenient assembly of each of the diamonds 12 to 18 within the seats 44 to 50, respectively, of gemstone setting 10 by the jeweler. The jeweler's initial steps are slidably setting the cut grooves (grooved slots) 12*e* and 14*e* of diamonds 12 and 14, respectively, onto the first retaining insert edge member 36 of the second crossbar 32, as depicted in FIG. 6 of the drawings. Then the jeweler slightly bends each of the upper ends 63 and 73 of prong holding members 62 and 72 inwardly to engage diamonds 12 and 14, respectively, such that the retaining wall members 64 and 66 of prong 62 are adjacent to and in contact with the side walls 12*a* and 12*b* of diamond 12. Also, the retaining wall members 74 and 76 of prong 72 are adjacent to and in contact with the side walls 14*a* and 14*b* of diamond 14 for securely holding in place diamonds 12 and 14 within seats 44 and 46, respectively, of gemstone jeweler setting 10.

The jeweler now repeats the aforementioned steps for diamonds 16 and 18 by slidably setting the cut-grooves (grooved slots) 16*e* and 18*e* of diamonds 16 and 18, respectively, onto the second retaining insert edge member 40 of the second crossbar 32, as depicted in FIG. 7 of the drawings. Then the jeweler slightly bends each of the upper ends 83 and 93 of prong holding members 82 and 92 inwardly to engage diamonds 16 and 18, respectively, such that the retaining wall members 84 and 86 of prong 82 are adjacent to and in contact with the side walls 16*a* and 16*b* of diamond 16. Also, the retaining wall members 94 and 96 of prong 92 are adjacent to and in contact with side walls 18*a* and 18*b* of diamond 18 for securely holding in place diamonds 16 and 18 within seats 48 and 50, respectively, of gemstone setting 10.

The jeweler's final step is to attach the connecting bar member 98 to a ring holding member 19 to form a finger ring, as shown in FIG. 10A of the drawings.

ALTERNATE EMBODIMENT 100

Figure 17:
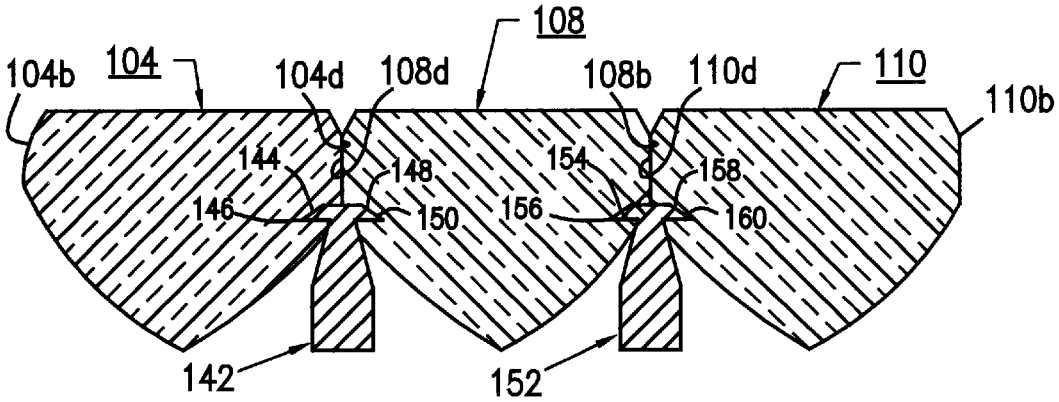
FIG. 17 is a cross-sectional view of the multi-stone setting of the present invention taken along lines 17—17 of FIG. 16 showing the second and third crossbars within the cut grooves of three diamonds.

In operation, the multi-stone setting 100 of the alternate embodiment of the present invention, as shown in FIGS. 11 and 16 to 18 of the patent drawings, starts with the jeweler initially mounting the connecting bar member 230 to a jewelry vise (not shown) for the convenient assembly of each of the diamonds 102 to 112 within each of the seats 162 to 172, respectively, of gemstone setting 100 by the jeweler. The jeweler's initial steps are to slidably mount the inner row 167 of diamonds 106 and 108 within seats 166 and 168, respectively, wherein the grooved slots 106*f* and 108*f* in diamonds 106 and 108 nestably engage the second retaining insert edge member 150 of the second crossbar 142 for nesting and seating of sidewalls 106*d* and 108*d* of diamonds 106 and 108 on the second crossbar 142, respectively, as depicted in FIGS. 11 and 17 of the drawings. Concurrently, the grooved slots 106*e* and 108*e* in diamonds 106 and 108 also nestably engage the second retaining insert edge member 156 of the third crossbar 152 for nesting and seating of side walls 106*b* and 108*b* of diamonds 106 and 108 on the third crossbar 152, respectively, as depicted in FIG. 11 of the drawings. Diamonds 106 and 108 are held in place by a pair of retaining bar members 107*a* and 107*b*, as depicted in FIGS. 11, 17 and 18 of the drawings.

The jeweler's next steps are to slidably set the grooved slots 102*e* and 104*e* in diamonds 102 and 104, respectively, onto the first retaining insert edge member 146 of the second crossbar 142, as depicted in FIGS. 11 and 17 of the patent drawings, for nesting and seating of the first outer row 163 of diamonds 102 and 14 on the second crossbar 142 within seats 162 and 164, respectively. Then the jeweler slightly bends each of the upper ends 194 and 204 of prong holding members 192 and 202 inwardly to engage diamonds 102 and 104, respectively, such that the retaining wall members 196 and 198 of prong 192 are adjacent to and in contact with the side walls 102*a* and 102*b* of diamond 102. Also, the retaining wall members 206, 208 of prong 202 are adjacent to and in contact with the side walls 104*a* and 104*b* of diamond 104 for securely holding in place diamonds 102 and 104 within seats 162 and 164 of the first outer row 163, respectively, of gemstone setting 100.

The jeweler again repeats the aforementioned steps for diamonds 110 and 112 by slidably setting the grooved slots 110*e* and 112*e* in diamonds 110 and 112, respectively, onto the first retaining insert edge member 160 of the third crossbar 152, as depicted in FIGS. 11 and 17 of the patent drawings, for nesting and seating of the second outer row 171 of diamonds 110 and 112 on the third crossbar 152 within seats 170 and 172, respectively. Then the jeweler slightly bends inwardly each of the upper ends 214 and 224 of prong holding members 212 and 222, respectively, such that the retaining wall members 216 and 218 of prong 212 are adjacent to and in contact with side walls 110*a* and 11*b* of diamond 110. Also, the retaining wall members 226 and 228 of prong 222 are adjacent to and in contact with the side walls 112*a* and 112*b* of diamond 112 for securely holding in place diamonds 112 and 110 within seats 170 and 172 of the second outer row 171, respectively, of gemstone setting 100.

The jeweler's final step is to attach the connecting bar member 230 to a clasp holding member 114 to form a clasp jewelry product, as shown in FIG. 18 of the drawings.

ADVANTAGES OF THE PRESENT INVENTION

Accordingly, an advantage of the present invention is that it provides for a multi-stone setting for holding therein four or six rectangular-shaped or square-shaped gemstones in which the combined aggregate of the four or six gemstones give a larger appearance than that of a single gemstone of a similar carat weight.

Another advantage of the present invention is that it provides for a multi-stone setting having four or six gemstones therein that is less expensive than a single gemstone of a similar carat weight.

Another advantage of the present invention is that it provides for a multi-stone setting having four or six princess cut gemstones therein which gives the appearance that the setting is substantially invisible at distances greater than 12 inches from the jewelry product.

Another advantage of the present invention is that it provides for a multi-stone setting that can be varied in size depending upon the total combined carat weight of the four or six gemstones within the setting.

Another advantage of the present invention is that it provides for a multi-stone setting that can be made from precious metals such as gold, silver, platinum or palladium for setting precious gemstones including diamonds, rubies, sapphires, emeralds and the like.

Another advantage of the present invention is that it provides for a multi-stone setting having four or six gemstones therein for use in personal adornment in the form of ornamental jewelry such as rings, pins, brooches, pendants, clasps, necklaces, bracelets, anklets and earrings.

Another advantage of the present invention is that it provides for a multi-stone setting that can be produced in an economical manner and is readily affordable by the jewelry consumer.

A latitude of modification, change, and substitution is intended in the foregoing disclosure, and in some instances, some features of the invention will be employed without a corresponding use of other features. Accordingly, it is appropriate that the appended claims be construed broadly and in a manner consistent with the spirit and scope of the invention herein.

What is claimed is:

1. A multi-stone setting having four gemstones or diamonds, comprising:

a) a rectangular-shaped setting having a first crossbar extending in a first direction and a second crossbar extending in a second direction perpendicular to said first direction; said first and second crossbars being located in different planes;

b) said first and second crossbars forming four seats each receiving one of said four gemstones or diamonds;

c) said four gemstones having four side walls, respectively, and four grooves formed in said four side walls, respectively;

d) said second crossbar having insert means being seated within said four grooves for keeping said four gemstones seated in said four seats;

e) said setting having four corners with four corner prongs mounted on said four corners, respectively;

f) each of said four corner prongs having a V-shaped configuration forming a right angle for engaging two side walls of one of said four gemstones; and g) said four V-shaped corner prongs engaging said four gemstones respectively to keep said four gemstones seated within said four seats of said setting.

2. A multi-stone setting in accordance with claim 1, wherein said rectangular-shaped setting is square-shaped.

3. A multi-stone setting in accordance with claim 1, wherein said rectangular-shaped setting includes a four-sided frame having four side frame members for forming a first pair of opposing side frame members and a second pair of opposing side frame members, said first crossbar being connected to said first pair of opposing side frame members, said second crossbar being mounted on top of said first crossbar and being connected to said second pair of opposing side frame members for forming said four seats, said four seats each having a rectangular shape.

4. A multi-stone setting in accordance with claim 3, wherein said four seats each have a square shape.

5. A multi-stone setting in accordance with claim 3, wherein said four corner prongs each have upper ends, and wherein the upper ends of said four corner prongs are higher than said four side frame members for directly engaging the side walls of said four gemstones.

6. A multi-stone setting in accordance with claim 1, wherein said four corner prongs curve inwardly and are joined together at a bottom end point.

7. A multi-stone setting in accordance with claim 6, wherein said bottom end point is integrally attached to a connecting bar member for attachment to a jewelry holding member for forming a piece of jewelry.

8. A multi-stone setting in accordance with claim 7, wherein said connecting bar member is used with a jewelry holding member to form a ring, a pin, a brooch, a pendant, a clasp, a necklace, a bracelet, an anklet or earrings.

9. A multi-stone setting in accordance with claim 1, wherein said multi-stone setting can be made from gold, silver, platinum, palladium, or other precious metals.

10. A multi-stone setting in accordance with claim 1, wherein said multi-stone setting can be made into different size settings based upon the weight of the four gemstones, said total weight being in the range 0.16 to 2.0 carats.

11. A multi-stone setting in accordance with claim 1, wherein said insert means include first and second projection members extending outwardly from said second crossbar.

12. A multi-stone setting having six gemstones or diamonds, comprising:

a) a rectangular-shaped setting having a first crossbar extending in a first direction; a second crossbar having first insert means extending in a second direction perpendicular to said first direction; a third crossbar having second insert means parallel to said second crossbar and also extending in said second direction; said first crossbar being located in a different plane than said second and third crossbars;

b) said first, second and third crossbars forming six seats each for receiving one of six gemstones or diamonds; said first, second and third crossbars defining two outer rows of seats to form four outer seats and one inner row of seats for receiving said six gemstones, to form a first outer row of gemstones, a second outer row of gemstones, and an inner row of gemstones, and said first and second outer rows of gemstones forming four outer gemstones;

c) said first outer row of gemstones having a first set of inner side walls for engaging said second crossbar, said first set of inner side walls having grooves formed therein for seating said first outer row of gemstones on said first insert means of said second crossbar;

d) said second outer row of gemstones having a second set of inner side walls for engaging said third crossbar, said second set of inner side walls having grooves formed therein for seating said second outer row of gemstones on said second insert means of said third crossbar;

e) said inner row of gemstones having first inner side walls for engaging said second crossbar and second inner side walls for engaging said third crossbar; said first and second inner side walls having grooves formed therein for seating said inner row of gemstones on said first insert means and said second insert means of said second and third crossbars, respectively;

f) said setting having four corners with four corner prongs mounted on said four corners, respectively;

g) each of said four corner prongs having a V-shaped configuration forming a right angle for engaging two side walls of one of said four outer gemstones in said first and second outer rows of gemstones; and h) said four V-shaped corner prongs engaging said four outer gemstones respectively to keep said four outer gemstones seated within said four outer seats of said setting.

13. A multi-stone setting in accordance with claim 12, wherein said rectangular-shaped setting includes a four-sided frame having four side frame members for forming a first pair of opposing side frame members and a second pair of opposing side frame members, said first crossbar being connected to said first pair of opposing side frame members, said second and third crossbars being mounted on top of said first crossbar and being connected to said second pair of opposing side frame members for forming six seats, said six seats each having a rectangular shape.

14. A multi-stone setting in accordance with claim 12, wherein said six seats each have a square shape.

15. A multi-stone setting in accordance with claim 13, wherein said four corner prongs each have upper ends, and wherein the upper ends of said four corner prongs are higher than said four side frame members for directly engaging said two side walls of each of said four outer gemstones.

16. A multi-stone setting in accordance with claim 12, wherein said four corner prongs curve inwardly and are joined together at a bottom end point.

17. A multi-stone setting in accordance with claim 16, wherein said bottom end point is integrally attached to a connecting bar member for attachment to a jewelry holding member for forming a piece of jewelry.

18. A multi-stone setting in accordance with claim 17, wherein said connecting bar member is used with a jewelry holding member to form a ring, a pin, a brooch, a pendant, a clasp, a necklace, a bracelet, an anklet or earrings.

19. A multi-stone setting in accordance with claim 12, wherein said multi-stone setting can be made from gold, silver, platinum, palladium, or other precious metals.

20. A multi-stone setting in accordance with claim 12, wherein said multi-stone setting can be made into different size settings based upon the weight of the six gemstones, said weight being in the range of 0.18 to 2.00 carats.

21. A multi-stone setting in accordance with claim 11, wherein said first insert means include first and second projection members extending outwardly from said second crossbar.

22. A multi-stone setting in accordance with claim 11, wherein said second insert means include first and second projection members extending outwardly from said third crossbar.

23. A multi-stone setting having four gemstones or diamonds, each having four side walls, comprising:

a) a rectangular-shaped setting having a first crossbar extending in a first direction and a second crossbar extending in a second direction perpendicular to said first direction; said first and second crossbars being located in different planes;

b) said first and second crossbars forming four seats each receiving one of said four gemstones or diamonds;

c) said four gemstones having four grooves formed in said four side walls, respectively;

d) said second crossbar having seating means being seated within said four grooves for keeping said four gemstones seated in said four seats;

e) said setting having four corners with four corner prongs mounted on said four corners, respectively; and f) said four corner prongs engaging said four gemstones respectively to keep said four gemstones seated within said four seats of said setting.

24. A multi-stone setting in accordance with claim 23, wherein each of said four corner prongs includes a V-shaped configuration forming a right angle for engaging two of said side walls of one of said four gemstones.

25. A multi-stone setting having six gemstones or diamonds, comprising:

a) a rectangular-shaped setting having a first crossbar extending in a first direction; a second crossbar having first insert means extending in a second direction perpendicular to said first direction; a third crossbar having second insert means parallel to said second crossbar and also extending in said second direction; said first crossbar being located in a different plane than said second and third crossbars;

b) said first, second and third crossbars forming six seats each for receiving one of six gemstones or diamonds; said first, second and third crossbars defining two outer rows of seats to form four outer seats and one inner row of seats for receiving said six gemstones, to form a first outer row of gemstones, a second outer row of gemstones, and an inner row of gemstones, and said first and second outer rows of gemstones forming four outer gemstones, each of said four outer gemstones having side walls;

c) said first outer row of gemstones having a first set of inner side walls for engaging said second crossbar, said first set of inner side walls having grooves formed therein for seating said first outer row of gemstones on said first insert means of said second crossbar;

d) said second outer row of gemstones having a second set of inner side walls for engaging said third crossbar, said second set of inner side walls having grooves formed therein for seating said second outer row of gemstones on said second insert means of said third crossbar;

e) said inner row of gemstones having first inner side walls for engaging said second crossbar and second inner side walls for engaging said third crossbar; said first and second inner side walls having grooves formed therein for seating said inner row of gemstones on said first and said second insert means of said second and third crossbars, respectively;

f) said setting having four corners with four corner prongs mounted on said four corners, respectively; and g) said four corner prongs engaging said four outer gemstones respectively to keep said four outer gemstones seated within said four outer seats of said setting.

26. A multi-stone setting in accordance with claim 25, wherein each of said four corner prongs includes a V-shaped configuration forming a right angle for engaging two of said side walls of one of said four outer gemstones in said first and second outer rows of gemstones.

27. A multi-stone setting having at least six gemstones or diamonds, comprising:

a) a four-sided setting having a plurality of crossbars including a first crossbar extending in a first direction;

a second crossbar having first insert means extending in a second direction perpendicular to said first direction; at least a third crossbar having second insert means parallel to said second crossbar and also extending in said second direction; said first crossbar being in a different plane than said second and said at least third crossbars;

b) said first, second and at least third crossbars forming at least six seats each for receiving one of at least six gemstones or diamonds; said plurality of crossbars defining two outer rows of seats to form at least four outer seats and at least one inner row of seats for receiving said at least six gemstones, to form a first outer row of gemstones, a second outer row of gemstones, and at least one inner row of gemstones, and said first and second outer rows of gemstones forming at least four outer gemstones, four of said outer gemstones forming four corner gemstones;

c) said first outer row of gemstones having a first set of inner side walls for engaging said second crossbar, said first set of inner side walls having grooves formed therein for seating said first outer row of gemstones on said first insert means of said second crossbar;

d) said second outer row of gemstones having a second set of inner side walls for engaging said at least third crossbar, said second set of inner side walls having grooves formed therein for seating said second outer row of gemstones on said second insert means of said at least third crossbar;

e) said at least one inner row of gemstones having first inner side walls for engaging said second crossbar and second inner side walls for engaging said third crossbar; said first and second inner side walls having grooves formed therein for seating said inner row of gemstones on said first insert means and said second insert means of said second and at least third crossbars, respectively;

f) said setting having four corners with four corner prongs mounted on said four corners, respectively; and g) said four corner prongs engaging aid four corner gemstones respectively to keep said four corner gemstones seated within their respective seats of said setting.

* * * * *